US007903105B1

(12) United States Patent
Lan et al.

(10) Patent No.: US 7,903,105 B1
(45) Date of Patent: Mar. 8, 2011

(54) METHODS AND APPARATUS TO IMPROVE EFFICIENCY IN COLD CATHODE FLUORESCENT LIGHT CONTROLLERS

(75) Inventors: Rayleigh Lan, Taipei Hsien (TW); Calum MacRae, San Francisco, CA (US)

(73) Assignee: Maxim Integrated Products, Inc., Sunnyvale, CA (US)

( * ) Notice: Subject to any disclaimer, the term of this patent is extended or adjusted under 35 U.S.C. 154(b) by 220 days.

(21) Appl. No.: 12/145,269

(22) Filed: Jun. 24, 2008

Related U.S. Application Data

(62) Division of application No. 11/433,189, filed on May 11, 2006, now Pat. No. 7,545,369.

(51) Int. Cl.
*G09G 5/00* (2006.01)

(52) U.S. Cl. ..... 345/204; 345/211; 345/212; 345/66; 345/102; 315/209 R; 315/224; 315/291; 315/247

(58) Field of Classification Search ..... 345/66, 345/92, 204, 211–214; 315/247, 224, 307, 315/291, 209 R
See application file for complete search history.

(56) References Cited

U.S. PATENT DOCUMENTS 5,166,579 A 11/1992 Kawabata et al.
6,856,119 B2 2/2005 Crawford
7,112,929 B2 9/2006 Chiou
7,313,006 B2 12/2007 Choi

OTHER PUBLICATIONS

Maxim Integrated Products, "Application Note 3528, CCFL Characteristics", (May 19, 2005).
Maxim Integrated Products, "MAX1739/MAX1839 Data Sheet, Wide Brightness Range CCFL Backlight Controllers", (Mar. 2001), pp. 1-26.
Maxim Integrated Products, "MAX753/MAX754 Data Sheet, CCFL Backlight and LCD Contrast Controllers", (Jan. 1995), pp. 1-16.
Maxim Integrated Products, "MAX8722 Data Sheet, Low-Cost CCFL Backlight Controller", (Jun. 2004), pp. 1-20.
Maxim Integrated Products, "MAX8729 Data Sheet, Constant-Frequency, Half-Bridge CCFL Inverter Controller", (Aug. 2005), pp. 1-26.
Maxim Integrated Products, "MAX8751 Data Sheet, Fixed-Frequency, Full-Bridge CCFL Inverter Controller", (Aug. 2005), pp. 1-27.

*Primary Examiner* — Tuyet Thi Vo
(74) *Attorney, Agent, or Firm* — Blakely Sokoloff Taylor & Zafman LLP

(57) ABSTRACT

Methods and apparatus to improve efficiency in cold cathode fluorescent light (CCFL) controllers using a full bridge resonant implementation. The secondary of a transformer drives the CCFL, with the primary of the transformer being driven through a capacitor from a full bridge. The bridge alternately and repetitively connects the capacitor and primary between power supply connections, across one of the power supply connections, between the power supply connections with an alternate polarity and again across one of the power supply connections. Instead of switching from across one of the power supply connections to between the power supply connections when the primary current is near zero, a delay is intentionally imposed before switching. This significantly improves the operating efficiency of a backlighting system. In preferred embodiments, the delay is made power supply voltage dependent.

9 Claims, 6 Drawing Sheets

METHODS AND APPARATUS TO IMPROVE EFFICIENCY IN COLD CATHODE FLUORESCENT LIGHT CONTROLLERS

CROSS-REFERENCE TO RELATED APPLICATION

This application is a divisional of U.S. patent application Ser. No. 11/433,189 filed May 11, 2006.

BACKGROUND OF THE INVENTION

1. Field of the Invention

The present invention relates to the field of cold cathode fluorescent light (CCFL) controllers.

2. Prior Art

Cold cathode fluorescent light (CCFL) backlight controllers are well known in the prior art, and are frequently used to backlight displays in battery powered devices such as laptop computers. In such applications where battery power is relatively limited, it is strongly desired to maximize the time between required battery recharges. Since the display, and in particular the backlighting therefore, creates a substantial power drain on the battery, improvements in the efficiency of the backlighting system are highly desirable.

Prior art CCFL backlight controllers are commercially available in various forms. By way of example, for applications such as laptop computers, fixed frequency full bridge controllers, fixed frequency half bridge controllers and resonant full bridge controllers are commercially available from Maxim Integrated Products, Inc. of Sunnyvale, Calif., assignee of the present invention. Examples of each of the foregoing are Maxim's MAX8751, MAX8729 and MAX8722, respectively.

DETAILED DESCRIPTION OF THE PREFERRED EMBODIMENTS

Figure 1:
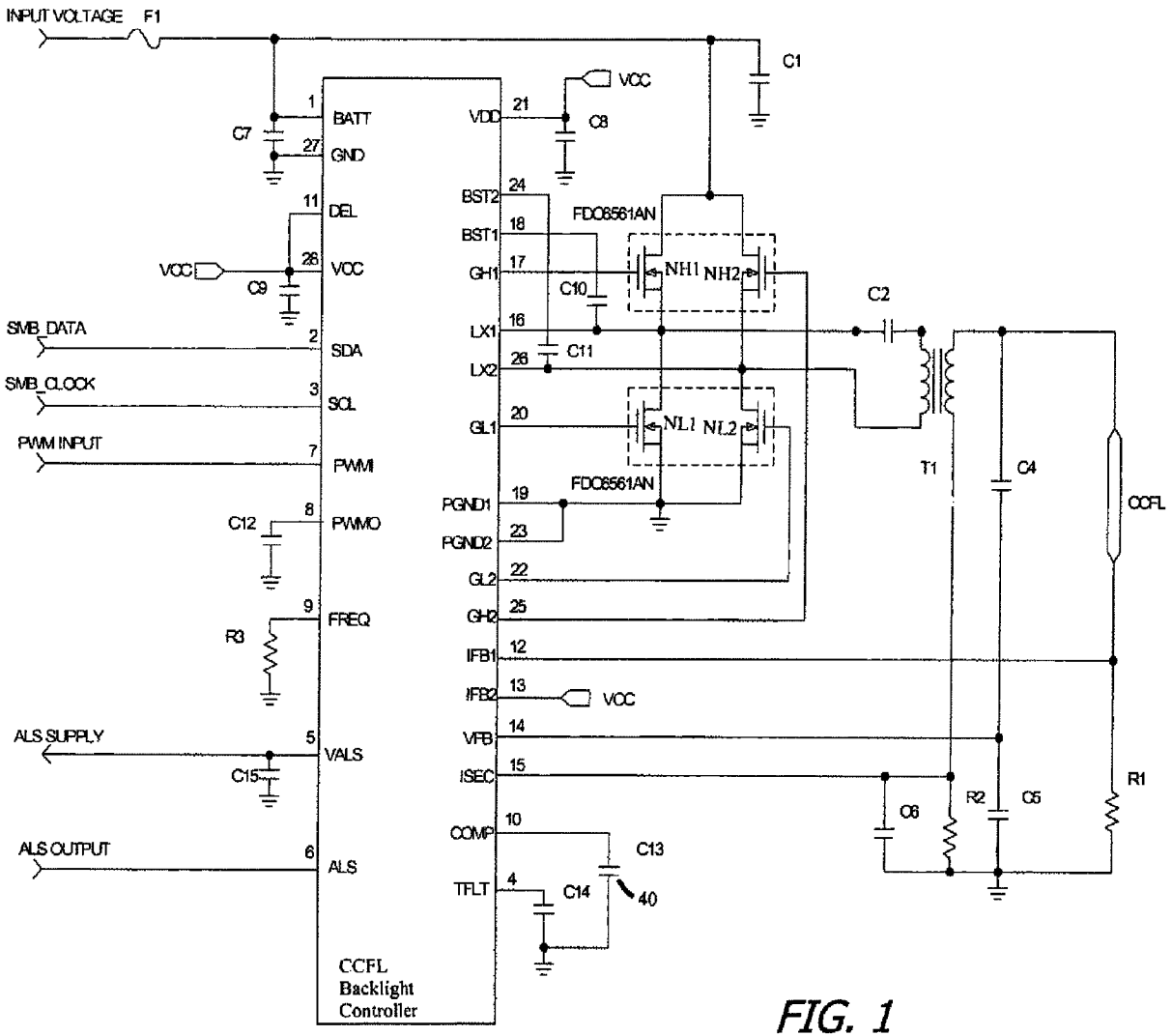
FIG. 1 is a diagram of an exemplary controller in accordance with the present invention together with associated external circuitry, including a resonant bridge and a cold cathode fluorescent lamp.

First referring to FIG. 1, a diagram of a CCFL backlight controller and associated circuitry incorporating a preferred embodiment of the present invention may be seen. The controller controls a full wave resonant bridge comprising n-channel transistors NH1, NL1, NH2 and NL2, coupled between the input voltage VBATT and a circuit ground. The gates of these transistors are controlled by the CCFL backlight controller through signals GH1, GL1, GH2 and GL2, respectively. Coupled as the load across the center of the bridge is a series connection of capacitor C2 and the primary of transistor T1, with the voltages at each end of the load being provided as inputs LX1 and LX2 to the CCFL backlight controller integrated circuit. The capacitor C2 blocks any DC currents through the primary of transformer T1, thereby assuring that the average voltage across the primary is zero. Also shown in this Figure, among other things, is a series connection of resistor R2, the transformer T1 secondary, the CCFL lamp itself, and series resistor R1. Series resistor R1 senses the lamp current of the CCFL, providing a feedback signal IFB1 used in the control of the full bridge. Resistor R2 provides a feedback signal ISEC proportional to the secondary current in transformer T1. While the feedback signals IFB1 and ISEC would appear to be proportional signals in the circuit of FIG. 1, the feedback signal ISEC is actually used to sense a short circuit, or at least an extraordinarily low impedance on the secondary of transformer T1, causing the current in the secondary as sensed by the signal ISEC to be substantially higher than the current through the CCFL sensed by the feedback signal IFB1. Thus, while this failsafe feature is included in the specific embodiment of the present invention, such feature is well known in the prior art and is not essential to the functioning of the preferred embodiment of the present invention.

Figure 2:
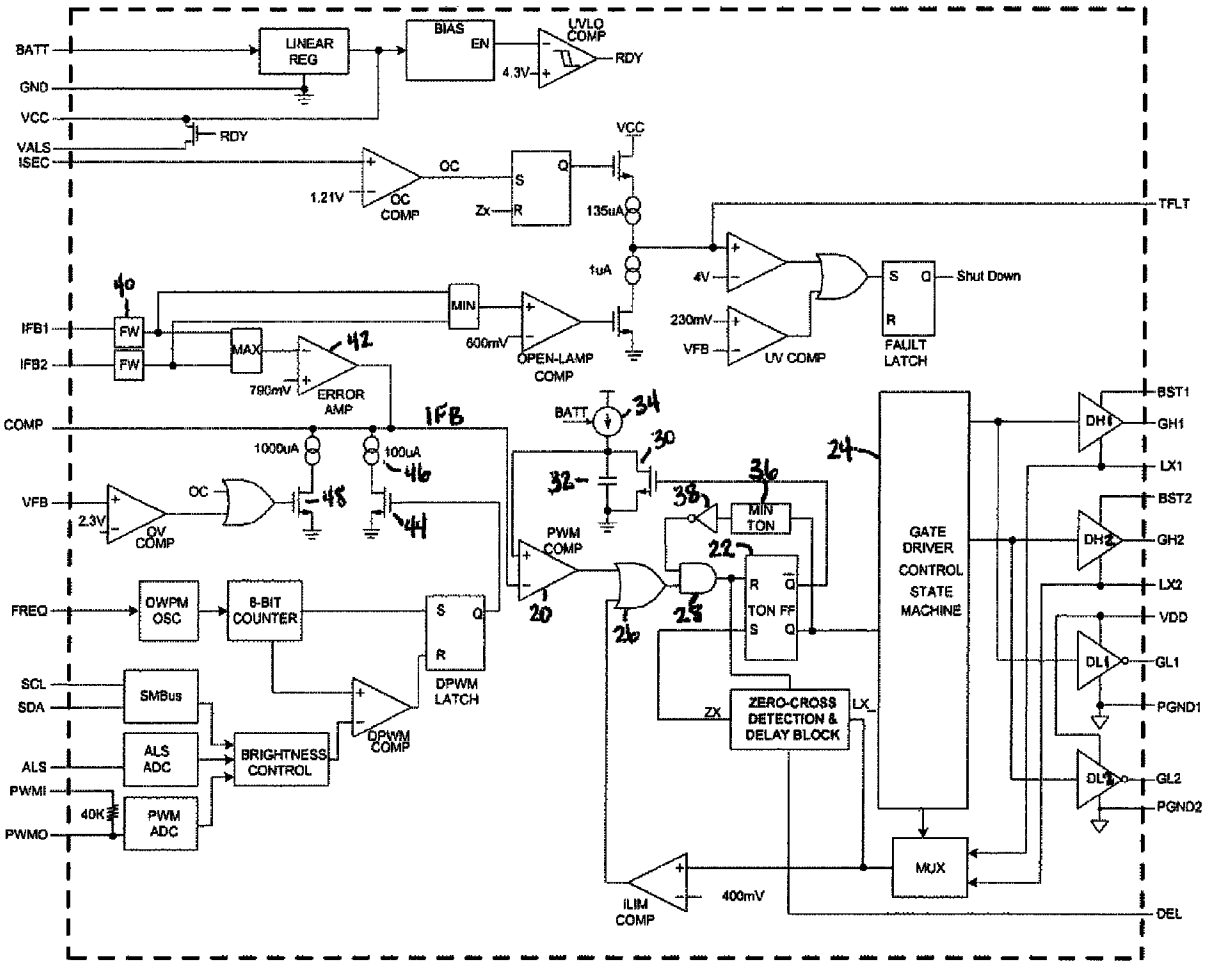
FIG. 2 is a diagram of the exemplary controller of FIG. 1.

Now referring to FIG. 2, a block diagram of the CCFL backlight controller of FIG. 1 may be seen. The parts of the controller shown in FIG. 1 that are of particular importance to the present invention are the pulse width modulator comparator 20, the RS flip-flop 22, the gate driver control state machine 24, the gate drivers DH1, DH2, DL1 and DL2, the multiplexer MUX, the zero cross detection and delay block, transistor 30, capacitor 32 and current source 34. Terminals LX1 and LX2 are each a voltage at a respective end of the series connection of capacitor C2 and the primary of transformer T1, as may be seen in FIG. 1. These voltages are coupled to the gate driver GH1 and gate driver GH2, as well as to the LX sense MUX. The four gate drivers drive the four transistors of the full bridge, as may be seen in FIG. 1. The multiplexer MUX is controlled by the gate driver control state machine, which selects one of the two voltages LX1 or LX2 for coupling to the zero cross detection and delay block, as well as the ILIM comparator, dependent upon the phase of operation of the controller. The ILIM comparator provides a safety function in that if the voltage across the transformer T1 primary is excessive, the output of the ILIM comparator will go high, providing a high output from the OR gate 26. However in the absence of a specific fault, the output of the ILIM comparator will remain low during the normal operation of the controller, holding one input to OR gate 26 low. Consequently, the output of OR gate 26 during normal operation is dependent only on the output of the pulse width modulator comparator 26.

Figure 3:
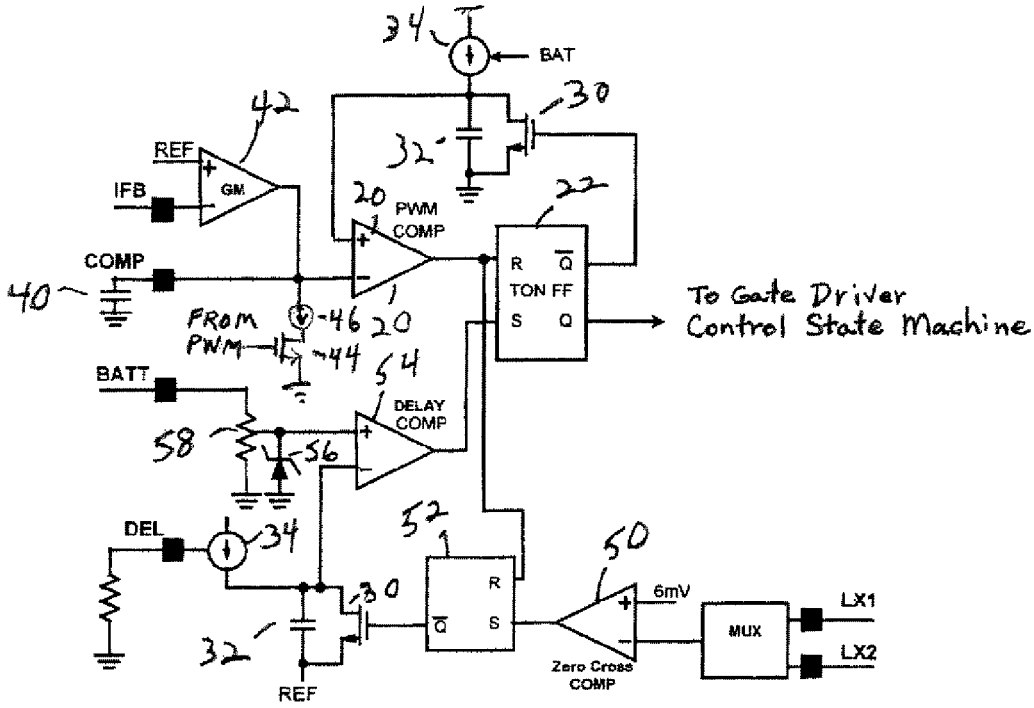
FIG. 3 is a simplified diagram of the delay circuit in the controller of FIGS. 1 and 2.

As shall subsequently be seen, when the Q output of the RS flip-flop 22 is high, one of the upper transistors NH1 or NH2 is turned on, as is one of the lower transistors NL1 or NL2 on the opposite side of the bridge, so as to couple the input voltage (battery voltage) to the series connection of capacitor C2 and the primary of transformer T1 in one or the other polarity. In order to assure that the CCFL does not go out, a minimum on time is imposed by block 36 controlling inverter 38 which holds a low output to AND gate 28 for a minimum time after the RS flip-flop 22 is set, thereby preventing the resetting of the flip-flop for at least a minimum time. Assuming, however, that the brightness control is set at a higher level, the output of inverter 38 will be high before the output of the pulse width modulator comparator 20 goes high. Thus for purposes of normal operation, OR gate 26 and AND gate 28 may be ignored and the output of the pulse width modulator comparator 20 may be considered to effectively be coupled directly to the reset input of the flip-flop 22. For purposes of explanation, this simplification has been made in FIG. 3, to be subsequently described.

Figure 6:
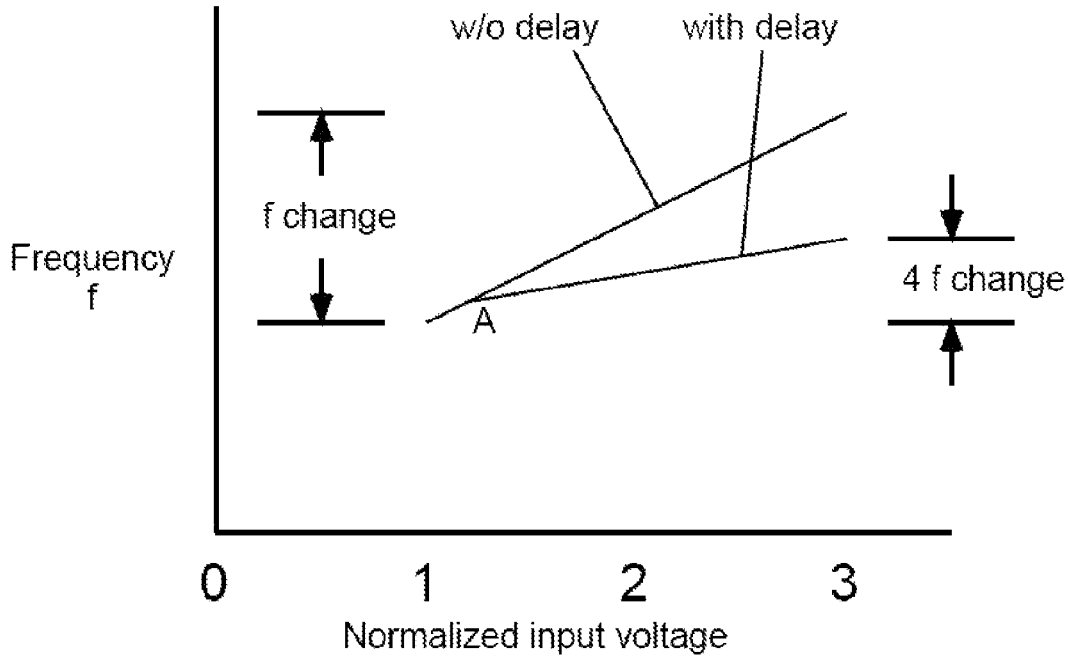
FIG. 6 is a graphical illustration of the limiting of the resonant frequency rise of the controller, capacitor, transformer and CCFL by the imposition of the delay.

As described with respect to FIG. 1, the gate driver control state machine of the preferred embodiment drives the four n-Channel power MOSFETs NH1, NH2, NL1 and NL2 that make up a zero-voltage-switching (ZVS) full-bridge inverter, as also shown in FIGS. 4*a* through 4*d*. Assume that transistors NH1 and NL2 are on at the beginning of a switching cycle as shown in FIG. 4(*a*). Current flows through MOSFET NH1, DC blocking capacitor C2, the primary side of transformer T1, and MOSFET NL2. During this interval, the transformer T1 primary current ramps up until the pulse width modulator pulls the negative input to the pulse width comparator 20 below the positive input, resetting flip-flop 22 to turn off transistor NH1. Now the transistor 30 is turned on, discharging capacitor 32 to drive the positive input to the pulse width comparator 20 below the negative input, removing the reset signal from the flop-flop 22. Also when transistor NH1 is turned off, the primary current forward biases the body diode of transistor NL1, which clamps the voltage LX1 just below ground, as indicated in FIG. 4(*b*) by the direction of continued current flow. When the controller turns on transistor NL1 shortly thereafter, its drain-to-source voltage is near zero because its forward-biased body diode clamps the drain voltage at one diode voltage drop below ground. Since transistor NL2 is still on, the primary current flows through transistor NL1, capacitor C2, the primary side of transformer T1, and transistor NL2. During this time, the multiplexer MUX is set to monitor the voltage LX2. Once the primary current drops to the minimum current threshold (6 mV/$R_{DS(ON)}$ in this exemplary embodiment, where $R_{DS(ON)}$ is the drain source voltage of transistor NL2 when on), the output of the zero cross comparator 50 will go high, setting the RS flip-flop 52. In a prior art controller of this type, the $\overline{Q}$ output of the RS flip-flop 52 would be coupled directly to the set input of flip-flop 22, thereby driving that set input low. Since the output of the pulse width modulator comparator 20 would be high at this time, this would immediately reset RS flip-flop 22, driving its Q output low again to advance the state machine to turn off transistor NL2. However in the present invention, setting the flip-flop 52 merely turns off transistor 30, which when on, discharges capacitor 30. With transistor 30 off, capacitor 32 begins to charge through current source 34. Assuming a good battery charge, the voltage to the delay comparator 54 from the voltage divider 58 will initially be higher than the voltage on the capacitor 32 when transistor 30 is first turned off, so that the output of the delay comparator 54 will remain high until capacitor 32 exceeds the voltage on the positive input to the delay comparator. Only then is RS flip-flop 22 allowed to reset, driving its Q output low again to advance the state machine to turn off transistor NL2. Thus a delay has been imposed before turning off transistor NL2. During the delay, the current may actually go to zero, and reverse because of the resonant system. Note that Zener diode 56 limits the maximum voltage that may be applied to the delay comparator 54, so that there is some battery voltage BATT above which no further delay will be imposed (point A in FIG. 6). On the other hand, if the battery voltage BATT is below a certain voltage, the positive input to the delay comparator 54 will be equal to or less than the voltage REF, in which case no delay is imposed. Therefore the delay depends on battery voltage, increasing from zero for some moderate battery voltage to an upper limit at another, higher battery voltage. The zero delay assures adequate brightness for lower battery voltages by eliminating the delay, but allows use of the delay for higher states of battery charge to allow realization of the higher efficiency obtainable.

When the controller turns off NL2, it turns on transistor NH2. If the primary current has not already reversed polarity, it now reverses polarity as shown in FIG. 4(*c*), beginning a new cycle with the current flowing in the opposite direction with transistors NH2 and NL1 on. The primary current then ramps up until pulse width modulator causes the controller to turn off transistor NH2. When transistor NH2 is turned off, the primary current forward biases the body diode of transistor NL2, which clamps the LX2 voltage just below ground as shown in FIG. 4(*d*). After the LX2 node goes low, the controller losslessly turns on transistor NL2. Once the primary current drops to the minimum current threshold based now on the voltage on node LX1 as selected by the multiplexer MUX, another delay is imposed as described above before the controller turns off transistor NL1 and turning on transistor NH1, beginning a new cycle as shown in FIG. 4(*a*).

It can be shown that the effect of the delay imposed by the present invention is to increase the operating efficiency of the resonant CCFL backlighting system by a significant percentage in comparison to similar prior art resonant CCFL backlighting system. Since operating time between charges is very important in battery operated devices, a significant decrease on power drain from the CCFL backlighting system is highly advantageous.

Other circuitry shown in FIG. 2 includes the pulse width modulator itself and the control therefore to control brightness, and other circuitry for fault detection. The negative input to the comparator 20 is the voltage IFB, the voltage across compensation capacitor 40 (FIG. 1) coupled to the COMP terminal of the CCFL backlight controller (see FIG. 1). The charge on capacitor 40 is controlled by the output of transconductance error amplifier 42, responsive to the voltage proportional to the CCFL lamp IFB1 and full wave rectified by the FW block 44. The charge on capacitor 40 may be discharged through transistor 44 by current source 46. In that regard, transistor 48 and the circuitry connected thereto responsive to the signal VFB is part of the fault detection circuitry to avoid excessive secondary voltages on transformer T1, and accordingly in normal operation, transistor 48 is off at all times.

In the preferred embodiment, the pulse width modulator is a digital pulse width modulator, the main components of which are the oscillator DWPM OSC, the 8 bit counter, the SMBus bus connection, the ALS analog to digital converter and the pulse width modulator PWM ADC analog to digital converter providing inputs to brightness control, the output of which together with the output of the 8 bit counter going the digital pulse width modulator comparator DPWM COMP. These components are well known in the prior art and need not be described further herein. At the top of FIG. 2 is shown a linear regulator providing biases for the various circuitry in the controller, with an undervoltage lockout comparator UVLO COMP disabling the controller if the battery voltage becomes too low to satisfactorily power the CCFL backlighting system. Finally, the comparator OS COMP, the RS flip-flop connected thereto and the circuitry connected to the Q output of the RS flip-flop are part of the fault detection circuitry, shutting down the controller and providing a fault output TFLT if the transformer secondary current becomes excessive, as sensed by the secondary current sensing signal ISEC.

The effect of the delay imposed by the present invention may be explained as follows. The resonant operation of such controllers has the characteristic that the operating frequency increases with increased input voltage for a fixed brightness. Since the lamp RMS current is regulated at a fixed value and lamp impedance is approximately fixed, the voltage across the lamp is substantially constant regardless of the changes in operating frequency. However the current that goes through capacitors C4 and C5 (FIG. 1) is proportional to the operating frequency. Hence for a higher operating frequency, the total current from the secondary of the transformer T1, the sum of the currents through the lamp and capacitors C4 and C5, increases. Since the higher transformer current will cause a larger conduction loss, this will decrease the electrical efficiency of the controller. Imposing the delay in accordance with the present invention substantially inhibits the frequency increase with increasing input voltage, avoiding most of the increase in conduction losses with increasing input voltage. In one embodiment, over an input voltage range of three to one, the frequency increase with increasing input voltage was reduced by the present invention to only 40% of what the frequency increase would have been without the delay of the present invention. Preferably, whatever technique is used to restrict the frequency increase with increasing input voltage, the frequency increase will be limited to at least 50% of what it would have been if the controller were allowed to free run as a conventional resonant full bridge cold cathode fluorescent light controller at its characteristic resonant frequency.

Figure 4A:
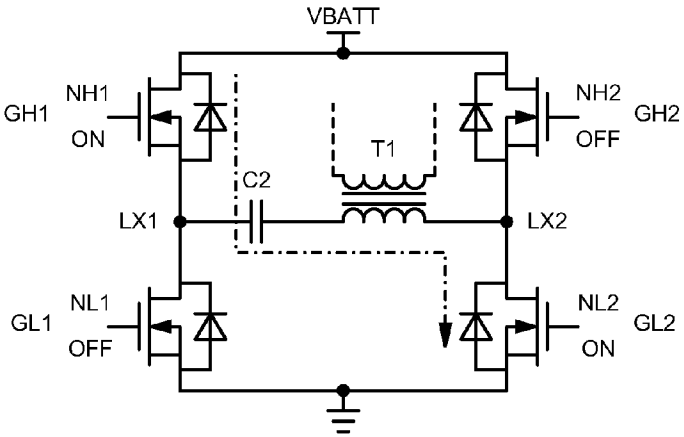
FIGS. 4*a* through 4*d* are diagrams illustrating the four successive stages of operation of the controller in controlling the resonant bridge of FIG. 1.
Figure 4B:
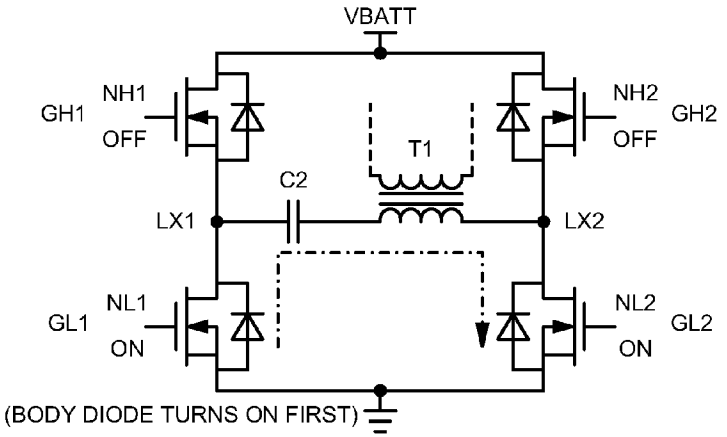
Figure 4C:
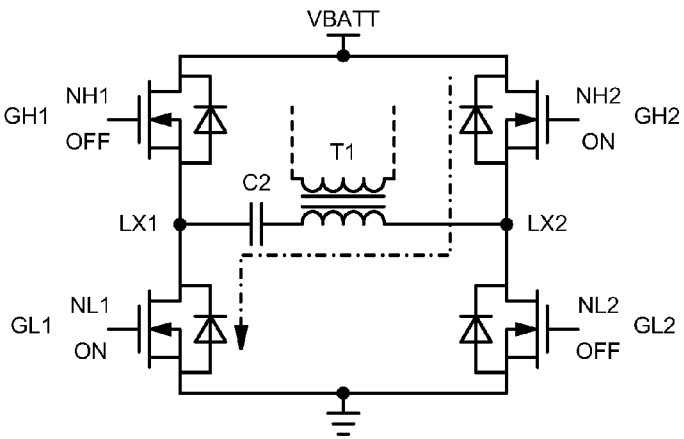
Figure 4D:
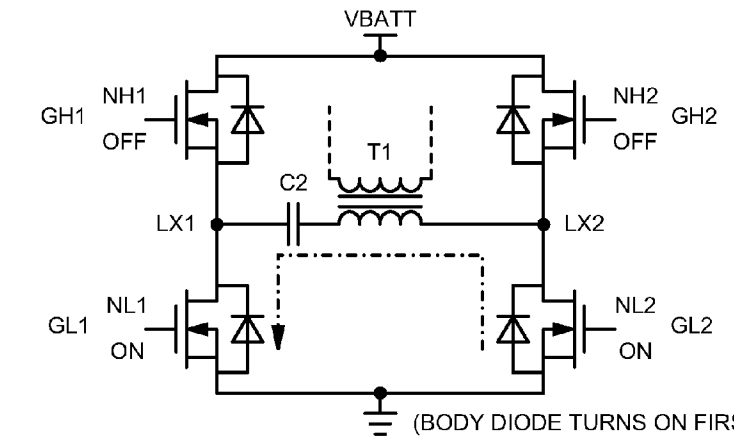
Figure 5:
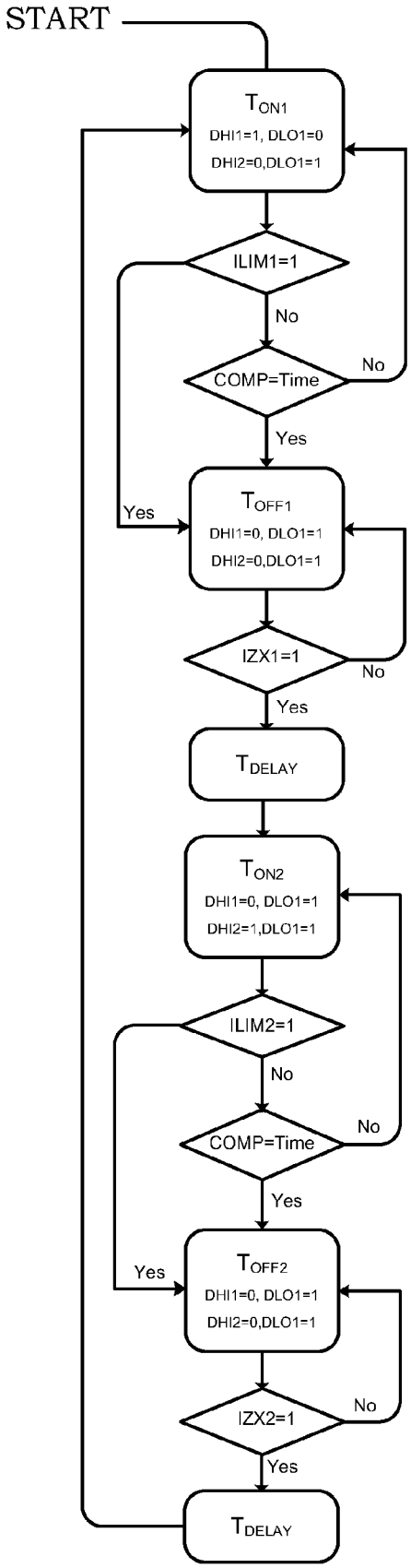
FIG. 5 illustrates an exemplary state machine diagram illustrating the operation of the present invention.

FIG. 5 is a state machine diagram illustrating the foregoing. In this diagram the symbols DH1, DH2, DL1 and DL2 represent the output states of the respective drivers for the gate signals GH1, GH2, GL1 and GL2 shown in FIG. 2. On initial START, DH1 and DL2 are both high and DH2 and DL1 are both low. This turns on the H bridge transistors NH1 and NL2 in accordance with FIG. 4*a*. The ILIM signal is a fault detect signal, and accordingly, is normally low. The block COMP=Time senses when the pulse width modulator comparator PWM COMP 20 of FIG. 2 times out, and then the state of the transistors in FIG. 4*a* is changed to the state indicated at $T_{OFF1}$, turning off the upper transistor NH1 and turning on the lower transistor NH1 as per FIG. 4*b*. When the ZERO-CROSS DETECTION & DELAY BLOCK (FIG. 2) senses the zero crossing (i.e., is within a predetermined range of zero) of the signal LX1 (XZ=1), a time delay $T_{DELAY}$ is initiated by that block, after which the signal ZX goes high. This causes the state machine to turn off transistor NL2 and turn on transistor NH2 as shown in FIG. 4*c*. Again, if there was no fault, ILIM2 (the second phase) will remain low, and again, when the pulse width modulator comparator PWM COMP 20 times out, transistor NH2 will be turned off and transistor NL1 turned on as in FIG. 4*d*, and again, after the zero crossing (i.e., is within a predetermined range of zero) of what is now the signal LX2, selected by the MUX of FIG. 2, goes through zero (XZ=1) the time delay $T_{DELAY}$ is again initiated, after which delay the state machine returns to the START condition for repeating the sequence just described. This sequence restricts the increase in the resonant frequency of the controller, capacitor, transformer and CCFL with increasing input voltage to a fraction of the characteristic resonant frequency increase with increasing input voltage, and generally no more than 50% of the characteristic resonant frequency increase with increasing input voltage.

While a preferred embodiment of the present invention has been disclosed and described herein for purposes of illustration and not for purposes of limitation, it will be understood by those skilled in the art that various changes in form and detail may be made therein without departing from the spirit and scope of the invention.

What is claimed is:

1. A method of operating a resonant full bridge cold cathode fluorescent light (CCFL) controller controlling current through first and second terminals of a series connection of a capacitor and a primary of a transformer, the CCFL being coupled across a secondary of the transformer, comprising:

coupling the first and second terminals of the series connection between first and second power supply terminals, respectively;

decoupling the first terminal of the series connection from the first power supply terminal responsive to a pulse width modulator controlled by a current feedback through the CCFL and control signals, and coupling the first terminal to the second power supply terminal;

when the current in the series connection is within a predetermined range of zero, initiating a delay;

at the end of the delay, coupling the first and second terminals of the series connection between the second and first power supply terminals, respectively.

2. The method of claim 1 wherein the method is practiced in a battery operated device, the method further comprising:

varying the time delay responsive to battery voltage.

3. The method of claim 2 wherein the time delay is zero at a first predetermined battery voltage and increases as the battery voltage increases from the first predetermined battery voltage.

4. The method of claim 3 wherein the time delay is constant above a second predetermined battery voltage, the second predetermined battery voltage being higher than the first predetermined battery voltage.

5. The method of claim 1 further comprised of:

decoupling one of the first and second terminals of the series connection from the respective power supply terminal responsive to a pulse width modulator controlled by a current feedback through the CCFL, and coupling the decoupled terminal to the opposite power supply terminal;

when the current in the series connection is within a predetermined range of zero, initiating a delay;

at the end of the delay, coupling the first and second terminals of the series connection between the second and first power supply terminals, respectively.

6. The method of claim 5 wherein the method is practiced in a battery operated device, the method further comprising:

varying the time delays responsive to battery voltage.

7. The method of claim 5 wherein the time delays are responsive to a power supply voltage.

8. The method of claim 7 wherein the time delays are zero at a first predetermined power supply voltage and increase as the power supply voltage increases from the first predetermined power supply voltage.

9. The method of claim 8 wherein the time delays are constant above a second predetermined power supply voltage, the second predetermined power supply voltage being higher than the first predetermined power supply voltage.

* * * * *